United States Patent [19]

Curati, Jr.

[11] 4,165,771

[45] Aug. 28, 1979

[54] IMPACT TOOL HAVING A PRE-FORMED FIBERGLASS HANDLE

[75] Inventor: Marino Curati, Jr., Geneva, Ohio

[73] Assignee: True Temper Corporation, Cleveland, Ohio

[21] Appl. No.: 899,078

[22] Filed: Apr. 24, 1978

[51] Int. Cl.[2] ..... B25C 1/00; B25D 1/00

[52] U.S. Cl. ..... 145/29 R; 145/61 R; 76/103

[58] Field of Search ..... 76/103; 16/110 R; 145/2 R, 29 R, 29 B, 36, 61 R, 61 A, 61 C, 61 H, 61 M

[56] References Cited

U.S. PATENT DOCUMENTS

| | | | |
|---|---|---|---|
| 1,435,851 | 11/1922 | Isham | 145/29 B |
| 2,837,381 | 6/1958 | Sarlandt | 145/61 R X |
| 2,940,492 | 6/1960 | Curry | 145/61 R |
| 3,040,762 | 6/1962 | West | 145/36 |
| 3,888,721 | 6/1975 | Allen | 76/103 X |
| 4,089,356 | 5/1978 | O'Connor | 145/61 R X |

*Primary Examiner*—Gary L. Smith

*Attorney, Agent, or Firm*—Baldwin, Egan, Walling & Fetzer

[57] ABSTRACT

An impact tool such as, for instance, a hammer, having a pre-formed fiberglass handle. The handle includes a handle portion and a head portion, the latter being receivable in a socket in the striking head of the tool, with the head portion comprising a ribbed section and a non-ribbed section, with the ribs extending only lineally on the head portion generally lengthwise of the handle, and disposed in spaced relation circumferentially of the head portion, and with the non-ribbed section disposed adjacent the ribbed section and diverging rearwardly in the direction of the handle portion. The ribs on the head portion are adapted to engage an intermediate, generally linear section in the socket of the striking head, and to be at least in tight, but preferably in partially crushed relation, for generally centering the head portion of the handle in the socket, and with the diverging non-ribbed section engaging the inner end of the striking head socket to limit movement of the handle into the head socket whereby the distal end of the ribbed section is spaced a predetermined minimum amount from the outer end of the socket, and a plastic material fills the socket, including the space intermediate the ribs, and the outer end of the socket, thereby firmly securing the handle and the striking head together.

11 Claims, 14 Drawing Figures

IMPACT TOOL HAVING A PRE-FORMED FIBERGLASS HANDLE

This invention relates in general to hand tools, and more particularly to an impact tool comprising a striking head and a pre-formed fiberglass handle securely attached to the head.

BACKGROUND OF THE INVENTION

It is known in the art to provide a pre-formed fiberglass impact tool handle with a head portion having non-linear rib structure thereon, running in the general direction of the extension of the lengthwise axis of the handle. Such ribs facilitate the assembly of the handle to the striking head of the tool, and aid in centering transversely the head portion of the handle in the socket of the striking head.

It is also known to fill the head socket, with the handle disposed therein, with a plastic resin material for securing or bonding the striking head to the handle, and vice versa. Sometimes, however, due to inaccurate formation of the metal striking heads and/or the handles, and the conventional size tolerances associated therewith, interference occurs between the head and the handle, prior to movement of the ribbed section on the handle completely into the socket of the striking head of the tool. This not only creates an unsightly and undesirable condition, but also results in a less secure connection between the striking head and the associated handle.

SUMMARY OF THE INVENTION

The present arrangement provides an impact tool wherein the ribbed section of the handle head will always be disposed completely within the socket of the striking head of the tool upon assembly of the handle with the striking head, with the head of the handle still having means thereon providing for limiting the movement of the handle into the striking head socket, whereby the distal end of the ribbed section of the handle head will be spaced a predetermined minimum amount from the outer end of the socket, thereby providing adequate space for receiving a plastic material therein which bonds or aids in securing the handle to the striking head of the tool.

Accordingly, it is an object of the invention to provide a novel arrangement for securing a striking head to a pre-formed fiberglass handle of an impact tool.

A still further object of the invention is to provide a novel arrangement securing a striking head of a hand impact tool to a pre-formed fiberglass handle thereof, and wherein the head portion of the handle includes a ribbed section with the ribs thereof extending only lineally in the general lengthwise direction of extension of the handle portion, and being received within the socket of the striking head, and having a non-ribbed head section which limits the movement of the handle into the striking head socket, whereby the distal end of the handle is spaced a predetermined minimum amount from the outer end of the socket, and receives in such space a plastic resin material for securely attaching the striking head to the handle.

Another object of the invention is to provide a pre-formed fiberglass handle for an impact tool comprising a handle portion and a head portion adapted to be received in the socket of the striking head of the tool, with the head portion of the handle comprising a ribbed section and a non-ribbed section, and with the ribs of the ribbed section extending only lineally, generally lengthwise of the handle, and disposed in spaced relation circumferentially of the handle portion, and with the non-ribbed section diverging rearwardly in the direction of the handle portion, and being adapted to limit the movement of the handle into the striking head socket, whereby the distal end of the ribbed section of the handle will be spaced a predetermined minimum amount from the outer end of the striking head socket, for insuring adequate space for receiving a plastic resin material in the socket of the striking head to securely attach the striking head to the handle.

Other objects and advantages of the invention will be apparent from the following description taken in conjunction with the accompanying drawings wherein:

DESCRIPTION OF PREFERRED EMBODIMENTS

Figure 1:
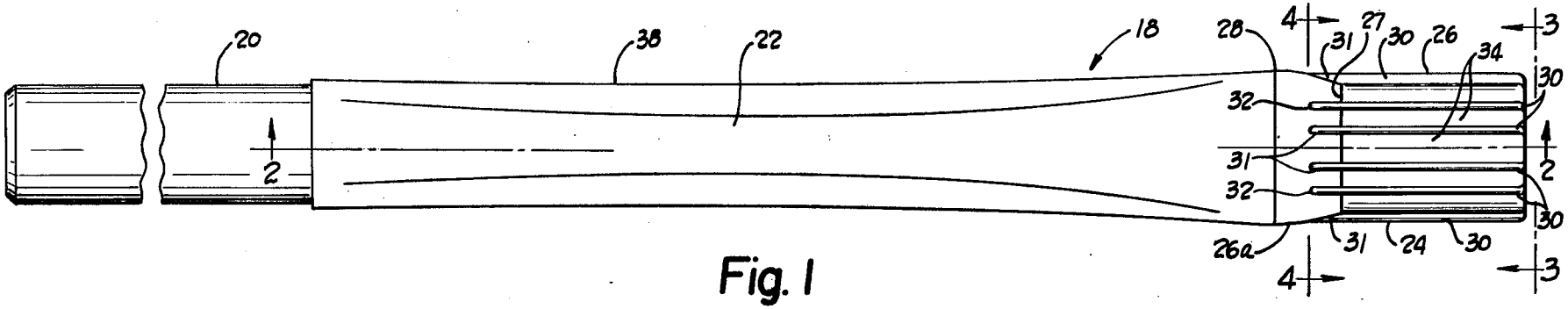
FIG. 1 is a broken side elevational view of a molded fiberglass handle for a striking tool formed in accordance with the invention.
Figure 2:
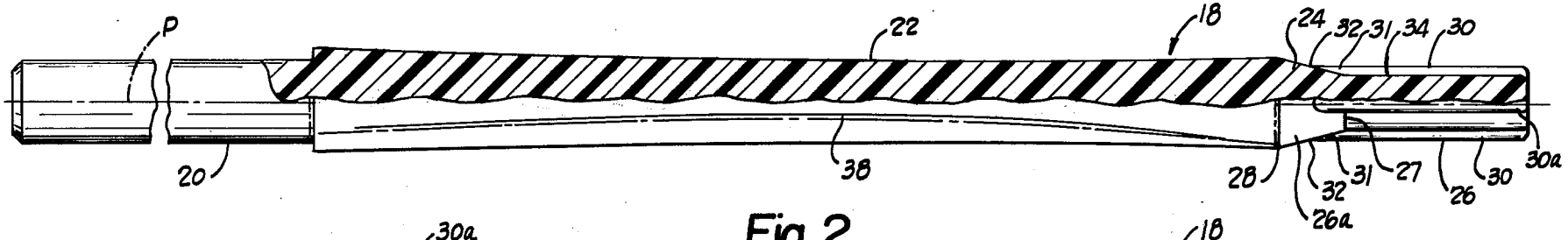
FIG. 2 is a partially sectioned view taken generally along the plane of line 2—2 of FIG. 1, looking in the direction of the arrows.

Referring now again particularly to FIGS. 1 to 7, there is disclosed an impact tool which, in the embodiment illustrated, is a claw hammer 10 (FIG. 5). The impact tool includes a striking head 12 having a socket 14 extending therethrough, with the socket 14 in the embodiment illustrated including a divergent outer end 14*a* and a divergent inner end 14*b*. In the embodiment illustrated, the socket comprises intermediate generally linear section 16 disposed intermediate the divergent outer and inner ends of the socket, and extending generally parallel to the direction of lengthwise extension of the handle.

In accordance with the invention, a formed plastic fiberglass handle 18 is provided for insertion into the socket 14 of the striking head. The handle 18 is preferably compression molded, using processes known in the art. U.S. Pat. No. 2,940,492 in the name of J. J. Currie, et al, and dated June 14, 1969, discloses various prior art methods for molding fiberglass handles. The handle which is adapted for use in the instant invention is the type formed from a bundle of elongated glass fiber strands which are generally longitudinally oriented and mixed with suitable plastic resin materials, such as for instance, epoxy resins, known in the art, and which, when placed under pressure and heat in a mold, form a suitable handle having sufficient flexure strength and impact resistance for use in an impact tool.

Figure 4:
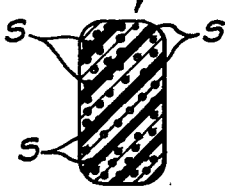
FIG. 4 is a sectional view taken generally along the plane of line 4—4 of FIG. 1, looking in the direction of the arrows and illustrating generally diagrammatically the fiberglass strands of which the handle is composed.
Figure 3:
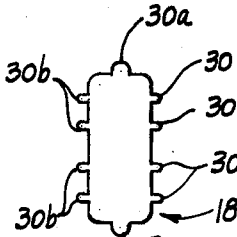
FIG. 3 is an end elevational view taken generally along the plane of line 3—3 of FIG. 1, looking in the direction of the arrows.
Figure 12:
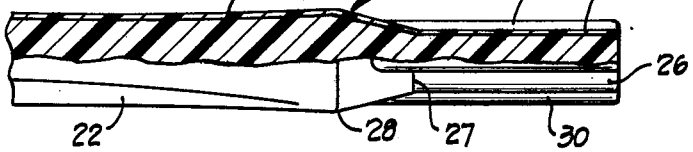
FIG. 12 is a fragmentary, partially sectioned view of a hammer handle similar to the embodiment illustrated in FIG. 2, and showing generally diagrammatically the position of one of the fiberglass strands of the material from which the handle is formed.

Some of the glass strands S (FIGS. 4 and 12) which reinforce the plastic resin material forming the molded handle are desirably disposed or oriented relatively close to the exterior surface of the handle, as diagrammatically illustrated in FIGS. 4 and 12, so as to give improved flexure strength and impact resistance to the handle.

Handle 18 comprises a grip portion 20 to which is adapted to be molded, or secured, a rubber handle covering (not shown), a central shank portion 22, and a head portion 24.

Head portion 24 includes a ribbed section 26 and a non-ribbed section 26*a* disposed immediately adjacent the ribbed section, and diverging outwardly commencing at 27, in the direction of the handle gripping portion 20 and the shank portion 22. The widest point of divergence of portion 26*a* is at 28 and as will be discussed hereinafter in greater detail.

The ribs 30 on the ribbed section 26 extend only lineally, lengthwise of the handle and extend beyond the ribbed section, as at 31, to merge smoothly as at 32 (FIG. 2) into the divergent defining surfaces of the non-ribbed section 26*a*.

Referring now to FIG. 12, it will be seen that the strands S of fiberglass which run generally longitudinally adjacent the surface of the handle portion, do not generally extend into the ribs 30 of the ribbed head section. During the compression molding procedure, the resinous material from which the handle is formed, flows into the cavities in the mold defining the ribs, and the fiberglass strand material S, due to its elongated and bundle-like nature, is maintained generally adjacent the surface of the shank and head portions of the handle, but out of the confines of the ribs. Thus the ribs are essentially formed of the more easily crushable resinous material as compared to the glass strand material.

Figure 5:
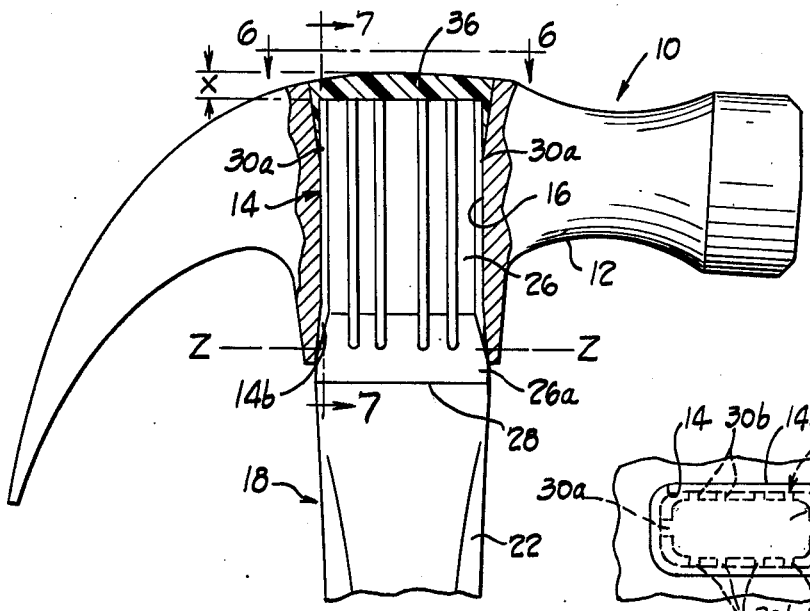
FIG. 5 is a broken, partially sectioned view of the handle of FIG. 1 assembled in the socket of a striking head of a hammer, with plastic resin material inserted into the head socket for securing or bonding the striking head to the handle.
Figure 6:
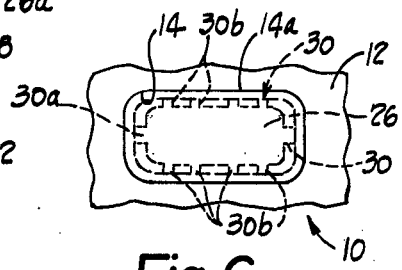
FIG. 6 is a fragmentary plan view taken generally along the plane of line 6—6 of FIG. 5, looking in the direction of the arrows.
Figure 7:
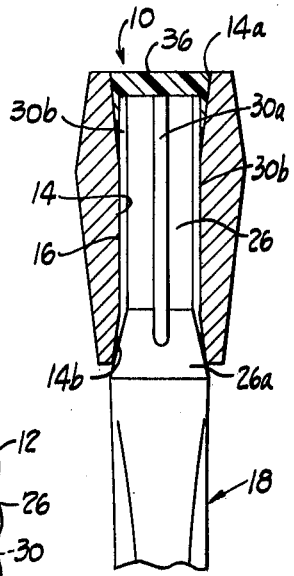
FIG. 7 is a fragmentary sectional view taken generally along the plane of line 7—7 of FIG. 5, looking in the direction of the arrows.
Figure 8:
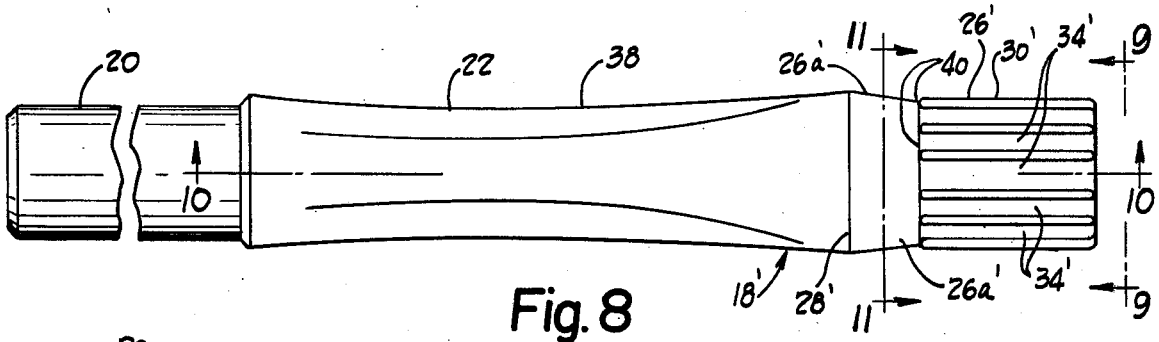
FIG. 8 is a broken, elevational view of another embodiment of fiberglass handle.
Figure 10:
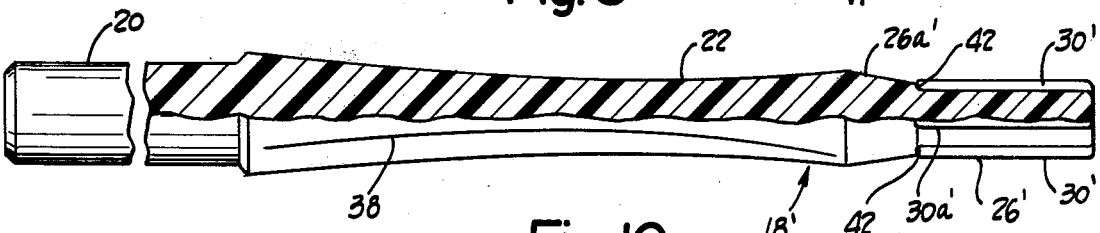
FIG. 10 is a broken, partially sectioned view taken generally along the plane of line 10—10 of FIG. 8, looking in the direction of the arrows.
Figure 9:
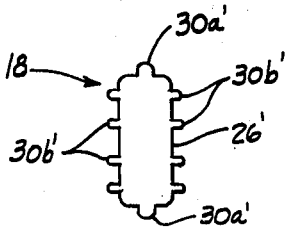
FIG. 9 is an elevational view taken generally along the plane of line 9—9 of FIG. 8, looking in the direction of the arrows.

The ribbed head section 26 is preferably so sized with respect to the size of the socket in the striking head that, when the handle is inserted into the socket from the inner end 14*b*, the ribs 30 are forced into extremely tight, and preferably crushed relation, with respect to the intermediate linear section 16 of the socket in the striking head, thus tightly wedging the handle in the socket while maintaining it generally centered with respect to the socket and compensating for irregularities in the socket configuration and dimensions. As can be seen in FIGS. 5, 6 and 7, (illustrating the preferred condition) the ribs 30 engaging the defining linear section surfaces 16 of the striking head socket, have been sheared or crushed somewhat so that the distal ends thereof rather than being rounded, upon assembly of the handle with the striking head, are generally flattened and are disposed in surface-to-surface relation with the defining surfaces of linear section 16 of the socket. This is so not only for the end ribs 30*a* on the ribbed section of the handle head portion, but also for the side ribs 30*b*.

The handle 18 is forced into the socket of the striking head until such time as the inner end 14*b* of the socket 14 is disposed in wedging relationship with the divergent defining surfaces of the non-ribbed section 26*a* of the handle head, and as shown, for instance, in FIGS. 5 and 7. This wedging contact limits entry of the handle head portion into the socket 14 of the striking head, whereby the distal end of the ribbed section is spaced a predetermined minimum amount X (FIG. 5) from the outermost end 14*a* of the striking head socket. This minimum amount X is approximately 0.2 inch.

Figure 14:
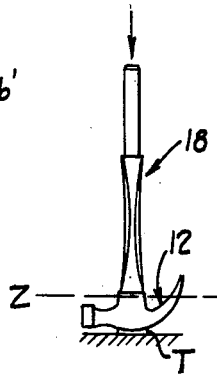
FIG. 14 is a diagrammatic illustration showing the assembly of a handle with a striking head of an impact tool.
Figure 11:
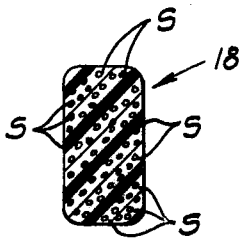
FIG. 11 is a sectional view taken generally along the plane of line 11—11 of FIG. 8, looking in the direction of the arrows; and illustrating generally diagrammatically the fiberglass strands of which the handle is composed.

Prior to inserting the handle, the socket 14 is filled with a predetermined amount of liquid plastic resin material such as an epoxy, well known in the art, with the outer end of the socket being closed over by tape T or the like (FIG. 14) so that it (the liquid plastic) will be retained therein; then when the handle is forced into the socket from the inner end 14*b*, the liquid plastic material flows in the spaces or troughs 34 between the ribs of the ribbed section and fills the area of the socket approximately to the plane Z—Z (FIGS. 5 and 14), it being understood that the handles are generally inserted into the socket in a downward direction, with the striking head 12 being disposed in inverted position, as shown, for instance, in FIG. 14. Upon setting or hardening of the plastic material 36, the striking head and handle are firmly attached or bonded together.

It will be seen that by having the ribs 30 only linear extending, the handle will move tightly but positively into the socket in the striking head during insertion of the handle therein. Thus, irrespective of the interference between the striking head and the handle at the non-ribbed divergent section 26*a*, the inner end of the striking head will generally always be disposed beyond the inner ends of the associated ribs, thus providing a better esthetic appearance, as well as providing more positive securement of the striking head to the handle, while maintaining a positive and tight engagement of the striking head with the handle at the head portion thereof. Since the ribs 30 are comprised almost solely of plastic resin, the ribs are deformable or shearable without tremendous interference, so as to permit the expeditious forced sliding entry of the handle into the striking head socket, irrespective of tolerance differentiations between the socket of the striking head and the molded fiberglass handle.

By maintaining a predetermined minimum distance or spacing X between the distal end of the ribbed section of the handle and the outer end of the socket in the striking head, there is insured a sufficient layer of plastic material for covering the end of the handle and preventing its visual appearance through the plastic, in the event that the latter is nearly clear or opaque. Moreover, a sufficient layer or bonding plastic material is insured to prevent relative movement between the striking head and the handle, and to positively anchor the latter in the striking head socket.

As aforementioned, the fiberglass handle is produced in a heated mold (not shown). In order to eliminate the need of hand removal of the conventional "flashing" at the parting line of the mold, such "flashing" in conventional production running along the longitudinal vertical center plane of the handle product, the parting line for the mold (diagrammatically illustrated by dot-dash line P—FIG. 2) is so arranged so as to run along or coincident with the contour line 38, FIGS. 1 and 2, of the shank portion 22 of the handle. Tumbling of the handle in a mechanical tumbler, such as a barrel tumbler, will generally adequately remove the flashing on the exposed portions (e.g. the shank portion) of the handle, with the parting line flashing disposed along the contour line 38. Accordingly, manual finishing of the handles is substantially eliminated. Mechanical tumbling of handles with the flashing running along the exterior of the handle at the longitudinal vertical center plane tehreof, will not remove the flashing in a manner that will adequately meet visual requirements, and therefore manual removal by scraping or grinding each individual handle becomes necessary.

Figure 13:
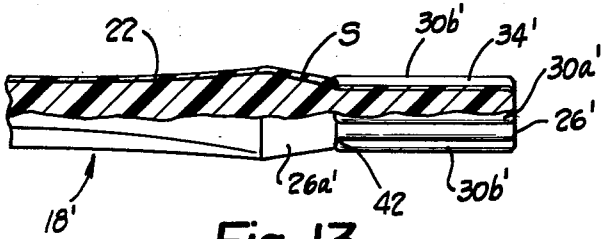
FIG. 13 is a view similar to FIG. 12, but showing the embodiment of handle illustrated in FIGS. 8 through 11.

Referring now to FIGS. 8 through 11, there is shown another embodiment of molded fiberglass handle 18'. In this embodiment, the ribs 30', rather than merging with the non-ribbed section 26 *a'* of the handle, are terminated as at 40, short of such a mergence and within the ribbed section 26' of the head portion. This not only insures that the ribs will be definitely disposed within the socket of the striking head, irrespective of considerable tolerance variations in the length of the socket in the striking head, but also generally insures that the elongated glass fiber strands forming the molded handle (FIGS. 11 and 13) will positively not extend or project into the ribs 30' of the head section, since the pressure and heat to which the handle is exposed during formation thereof, causes the glass fibers, due to their elongated bundle-like nature, to be compressed down at least to the surfaces defining the trough areas 34' between the ribs 30' of the ribbed section of the handle. The juncture between the inner or bottom surfaces of the troughs and the sloping or divergent defining surfaces of the non-ribbed section 26*a'* are preferably rounded as at 42 (FIG. 10) so as to prevent stress concentration at such junctures. Moreover, and as can be seen in FIG. 13, the elongated strands S of glass fiber forming the body of the handle, are disposed adjacent the surface of the handle body and generally insure that sufficient strength and flexure exists for the purposes to which the handle is subjected in use. The inner end of the striking head socket preferably engages the divergent non-ribbed section 26*a'* at approximately the same location thereon as in the first described embodiment, so as to limit entry of the handle into the striking head socket.

From the foregoing discussion and accompanying drawings, it will be seen that the invention provides a novel impact tool comprising a striking head having a handle receiving socket therein extending through the head, and including inner and outer ends with a preformed fiberglass handle having a head portion and a gripping or handle portion, with part of the head portion being received in the socket from the inner end thereof, and with the handle comprising a ribbed section and a non-ribbed section, with the ribs of the ribbed section extending only lineally generally lengthwise of the handle, and with the non-ribbed section disposed adjacent said ribbed section and diverging rearwardly in the direction of the handle portion. The ribs provide for tight engagement of the head section of the handle with the defining surface of the socket and provide general centering of the head portion in the socket, and the non-ribbed section engages the diverging end of the striking head socket and limits the movement of the handle into the head socket whereby the distal end of the ribbed section is disposed a predetermined minimum amount from the outer end of the socket, and then a plastic material fills the socket intermediate the ribs and filling the outer end of the socket, to firmly bond or secure the striking head and the handle together. The ribs are so constructed and arranged so as to provide an interference fit between the striking head and the handle over a considerable manufacturing tolerance range for the striking head socket.

The terms and expressions which have been used are used as terms of description and not of limitation, and there is no intention in the use of such terms and expressions and excluding any equivalents of any of the features shown or described, or portions thereof, and it is recognized that modifications are possible within the scope of the invention claimed.

What is claimed is:

1. An impact tool comprising a striking head having a handle receiving socket therein extending through said head, and including inner and outer ends, a preformed fiberglass handle having a head portion and a handle portion, part of said head portion being received in said socket said inner end thereof, and comprising a ribbed section and a non-ribbed section, said ribbed section comprising ribs extending only lineally generally lengthwise of said handle and disposed in spaced relation circumferentially of said head portion, said non-ribbed section being disposed adjacent said ribbed section and diverging rearwardly in the direction of said handle portion, said socket diverging outwardly at said inner end and said ribbed section being disposed interiorly of said socket intermediate said outer and inner ends thereof, said socket having an intermediate generally linear section with said ribs tightly engaging said linear section of said socket, and generally centering said head portion in said socket transverse thereof, said non-ribbed section engaging said diverging inner end of said head socket and limiting the movement of said handle into said head socket whereby the distal end of said ribbed section is spaced a predetermined minimum amount from said outer end of said socket, and a plastic resin material filling said socket intermediate said ribs and filling said outer end of said socket.

2. A tool in accordance with claim 1 wherein said linear ribs merge smoothly into the divergent surfaces of said non-ribbed section.

3. A tool in accordance with claim 1 wherein said linear ribs are terminated upstream from the divergent surfaces of said non-ribbed section.

4. A tool in accordance with claim 1 wherein said plastic resin material is epoxy resin.

5. A tool in accordance with claim 1 wherein said fiberglass handle is comprised of elongated glass fiber strands generally longitudinally oriented and arranged with their axes located generally parallel to each other, and to the principal axis of said handle, at least some of said oriented strands being disposed close to the surface of said handle and providing flexure strength thereto.

6. An impact tool in accordance with claim 1 wherein said fiberglass handle is formed from elongated glass fiber strands and a thermosetting polyester resin, with said strands reinforcing said resin and with said strands being oriented substantially parallel to the longitudinal axis of the handle, at least some of said strands being disposed generally immediately adjacent the exterior surface of said handle, and providing flexure strength to the latter.

7. A pre-formed plastic fiberglass handle adapted for assembly with a striking head of an impact tool with the striking head having a socket therein extending through the head and being divergent at least at the inner end of the socket, the handle being adapted for assembly with the head from the inner end of the socket, said handle comprising, a head portion and a handle portion, said head portion including a ribbed section and a non-ribbed section disposed adjacent said ribbed section, said non-ribbed section diverging rearwardly in the direction of said handle portion, said ribbed section comprising a plurality of ribs extending only lineally generally in the lengthwise direction of extension of said handle and being disposed in spaced relation circumferentially of said head portion, said ribbed section being adapted for tight fitting relation to the interior defining surface of the socket for generally centering said head portion in the socket of the striking head, said ribs being of predetermined length so as to be disposed intermediate the outer and inner ends of the socket when said handle is assembled with the striking head and with said non-ribbed section being adapted for engagement with the inner end of the socket for limiting movement of the handle into the socket during assembly thereof, said handle being adapted to be inserted into the socket along with a supply of plastic resin for causing the resin to occupy the spacing between said ribs.

8. A handle in accordance with claim 7 wherein the material of said handle is a thermosetting polyester resin with reinforcing glass fiber roving disposed therein, the roving extending generally parallel to the lengthwise axis of said handle, said material being compression molded under heat and pressure.

9. A handle in accordance with claim 7 wherein the spaces between said ribs comprise elongated slots, the bottom defining surface of each of said slots merging smoothly in a divergent manner with said non-ribbed section of said head portion.

10. A handle in accordance with claim 7 wherein said linear ribs are terminated prior to mergence with said non-ribbed section.

11. A handle in accordance with claim 7 wherein said ribs merge into said non-ribbed section, the distance lengthwise of said handle between the transverse plane of mergence of said ribs with said non-ribbed section to the transverse plane at the point of maximum divergence of said non-ribbed section being generally equal to the lengthwise distance between the first-mentioned transverse plane and the transverse plane passing through the inner ends of the slots defined between said ribs.

* * * * *